US005591022A

United States Patent [19]

Protos

[11] Patent Number: 5,591,022

[45] Date of Patent: Jan. 7, 1997

[54] SCROLL COMPRESSOR WITH INTEGRAL ANTI ROTATION MEANS

[75] Inventor: Paul T. Protos, Englewood, Ohio

[73] Assignee: General Motors Corporation, Detroit, Mich.

[21] Appl. No.: 544,686

[22] Filed: Oct. 18, 1995

[51] Int. Cl.[6] ..... F01C 1/04

[52] U.S. Cl. ..... 418/55.3; 418/55.2

[58] Field of Search ..... 418/55.2, 55.3

[56] References Cited

U.S. PATENT DOCUMENTS

| | | | |
|---|---|---|---|
| 801,182 | 10/1905 | Creux . | |
| 4,484,869 | 11/1984 | Kakayama et al. | 418/55 |
| 4,526,521 | 7/1985 | Sudbeck et al. | 418/55.3 |
| 5,051,075 | 9/1991 | Young | 418/55.3 |
| 5,366,359 | 11/1994 | Bookbinder et al. | 418/55.5 |
| 5,527,166 | 6/1996 | Chang et al. | 418/55.2 |

*Primary Examiner*—Charles G. Freay
*Attorney, Agent, or Firm*—Patrick M. Griffin

[57] ABSTRACT

A scroll compressor is disclosed that has a novel anti rotation means, which is incorporated directly into the wraps of the scrolls themselves, rather than comprising a separate mechanism. The scroll wraps are machined with integral, semi cylindrical troughs and ridges, which have centers lying on equally angularly spaced swing radius lines. The troughs and cylinders on the two scrolls are angularly offset relative to one another by one half of the equal angular increment that separates the swing radius lines on which the troughs and ridges lie. The difference between the radius of the larger troughs an smaller ridges is equal to the inherent orbital radius of the scrolls. This geometrical relationship allows the ridges to move along and through the troughs as the scrolls relatively orbit with, at any point in the cycle, at a pair of adjacent ridges engaged with opposing halves of adjacent troughs. Thus, the scrolls are always prevented from relatively rotating as they relatively orbit.

2 Claims, 9 Drawing Sheets

SCROLL COMPRESSOR WITH INTEGRAL ANTI ROTATION MEANS

This invention relates to scroll compressors in general, and specifically to a new design in which the mechanism that aligns and maintains the scrolls with a fixed angular offset relative to one another is integrally incorporated into the scrolls themselves, eliminating the need for a conventional, separate mechanism to do so.

BACKGROUND OF THE INVENTION

The basic concept of a compressor using pairs of involute spiral scrolls is a venerable one at this point. As shown in FIGS. 17 through 19, which are taken from a 1905 U.S. Pat. No. 801,182 to Creux, an involute scroll, indicated generally at 10, is generated by a non stretchable line 12 being unwrapped from around the circumference of a so called generating circle 14 of radius Rg. The string, being held at one fixed point, constitutes a so called swing radius, and traces out the spiral involute or curve shown. If stopped at any point, the line formed by the string, (several such equally spaced lines are shown in FIG. 17) called a swing radius line, is not the same length as it would be stopped at any other point, because it is being unwound. FIG. 17 shows a single line to represent the spiral, which, obviously, does not represent well an object that could exist in reality. However, as shown in FIG. 18 simply regenerating the same spiral with a slightly shorter string, shorter by an amount "t", generates a second, congruent spiral curve line, giving an inner surface and an outer surface, termed inner and outer wraps 16 and 18. The wraps 16 and 18 run from an inner edge 20 to an outer edge 22. Scroll 10 covers only one complete turn, or 360 degrees, from edge 20 to edge 22, although it could, if desired, cover more. In practice, scrolls generally will cover more than one turn, at least one and a half turns, for practical reasons. As shown in FIG. 19, if these wraps 16 and 18 are in turn bounded by parallel, axially spaced planes represented by a disk shaped end plate 24 and an axial end edge 26, a complete scroll 10 results.

In FIG. 20 two scrolls of the general type described above, but covering one and a half turns each, are indicated generally at 28 and 30. These, if interfitted by reversing one and axially pushing them one within the other, followed by angularly offsetting them by 180 degrees and radially offsetting them by a distance Ro (defined below) will create at least two (here, four) lines of contact between the juxtaposed inner and outer wraps. These lines of contact, in turn, define two pockets, indicated by shading. The distance Ro is defined as (P/2)–t, where P is the so called pitch of the scroll, which, in turn, is equal to the circumference of the generating circle described above. If one scroll is fixed while the other is orbited about the axis of the fixed scroll with the orbit radius Ro maintained, as indicated in FIG. 20, then all parts of the orbiting scroll, such as the point near the outer edge illustrated, rotate in a circle of radius Ro. If, during orbiting, some mechanism also prevents the scrolls from relatively rotating, then the lines of contact will shift along the wrap surfaces continually inwardly, shrinking the pockets continually inwardly and then reforming them at the rim of the outer rim of the scrolls. This creates a theoretically simple compressor, with low pressure gas introduced to the pockets at the rim and squeezed continually down toward the center.

While the above description sets out the general theory of the scroll compressor, its practical application has involved decades of learning how to actually machine the scroll and of developing workable, cost effective mechanisms to orbit the scroll at the orbit radius, to prevent the orbiting scroll from rotating relative to the fixed scroll as it orbits, and to assemble all of the components of the various mechanisms into proper alignment. The drive mechanism, almost universally, is an eccentric crank which drives the orbital scroll about the fixed scroll with the appropriate orbit radius. An example of this general drive mechanism can be see in essentially any scroll compressor patent, in one form or another. Design work has focused on new ways to manufacture and counterbalance the eccentric crank, as well as to provide a measure of radial yield to accommodate scroll wear or contaminant particles between the contacting scroll wraps. An example may be seen in co assigned U.S. Pat. No. 5,366,360 to Bookbinder et al. But the basic operation of the eccentric crank is little changed. The anti rotation mechanism (the means that maintains the proper angular offset between the scrolls in operation) is more diverse, but is most often either an Oldham ring, an example of which is disclosed in U.S. Pat. No. 4,484,869 or a ball coupling mechanism, an example of which is also disclosed in the co assigned '360 patent. Other anti rotation mechanisms have been proposed, but all have the same basic function of allowing the orbiting scroll to orbit with the proper radius, while preventing it from rotating as it does so. The primary drawback of all anti-rotation mechanism is the large number of components that comprise, which are costly and occupy space within the compressor, as well as the great difficulty during assembly in getting all the components properly relatively aligned. This is especially true of the standard ball coupling mechanisms, which requires numerous pins and slots to properly align the ball races.

SUMMARY OF THE INVENTION

The compressor of the invention uses a standard orbiting drive mechanism, but provides a very different approach to preventing the orbiting scroll from rotating relative to the fixed scroll as it orbits. Instead of a separate anti-rotation mechanism, a novel scroll wrap configuration is disclosed, incorporated directly into the scrolls themselves when they are machined, which prevents relative scroll rotation, as well as allowing the scrolls to self align when the scroll compressor is assembled.

In the preferred embodiment disclosed, a conventional orbital drive mechanism like that discussed above is used, driven by a main shaft supported in a front compressor head. The front compressor head closes with a cylindrical compressor housing. A fixed scroll is secured non rotationally within the compressor housing, and an interfitted orbital scroll is driven in the appropriate orbit radius by the drive mechanism. However, there is no separate anti rotation mechanism located between the orbital scroll and the front compressor head, as in a conventional compressor.

Instead of a separate anti-rotation mechanism to keep the orbital scroll at its predetermined, 180 degree angular offset relative to the fixed scroll, novel structural features are machined integrally into the contacting inner and outer wraps of the scrolls themselves which interengage in such a way as to prevent relative rotation. Each wrap of each scroll is machined with a plurality of pairs of interfitting, semi cylindrical troughs and ridges, superimposed on the basic involute shape of the wraps themselves, and running parallel to the respective scroll axes. The centers of both the concave troughs and convex ridges are equally angularly spaced, and lie on swing radius lines of the wraps. The difference in radius between the larger trough and smaller ridge of each interengaged pair is equal to the predetermined orbit radius. This basic geometrical relation assures that as the orbital scroll is driven and the rolling line contacts move, successive ridges move through troughs, and the line of contact, in effect, moves through them as well. The number of trough-ridge pairs is sufficient that there are at least two actually engaged at any time, with one ridge engaged with one half of the trough and the other ridge engaged with the other half of the trough. This prevents relative rotation of the scrolls both clockwise and counterclockwise, with no other mechanism needed. The lack of a separate anti rotation mechanism provides a further advantage during scroll installation. When the scrolls are pushed axially together, they can interfit only when the ridges properly engage the troughs, thereby self aligning without the use of pins or other additional scroll alignment components or assembly steps.

DESCRIPTION OF THE PREFERRED EMBODIMENT

These and other features of the invention appear from the following written description, and from the drawings, in which.

Figure 1:
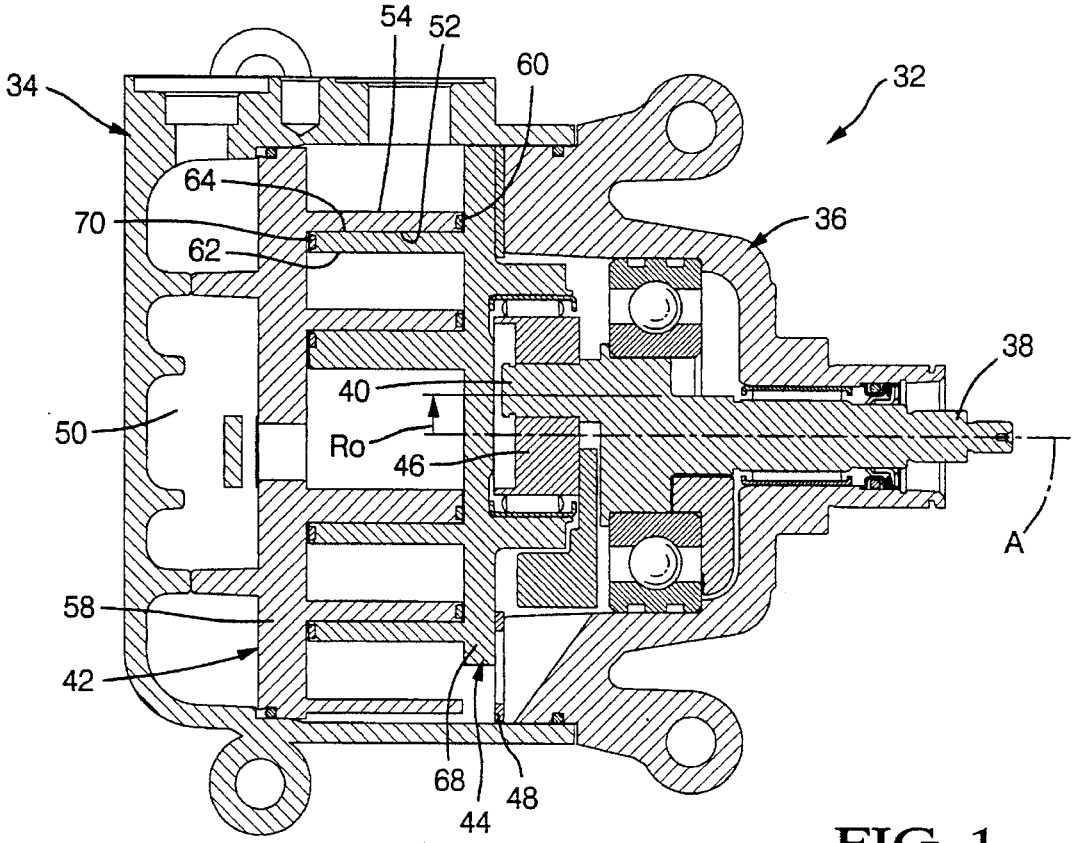
FIG. 1 is a cross section through a scroll compressor embodying the novel, scroll integral anti rotation mechanism of the invention.
Figure 2:
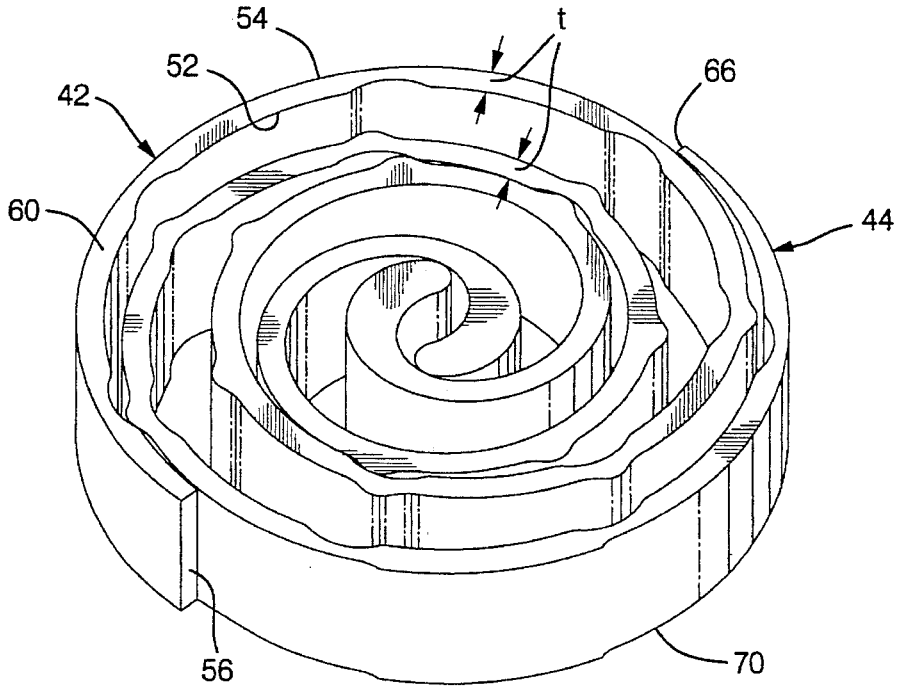
FIG. 2 is a perspective view of just the interfitted scroll wraps.

Referring first to FIGS. 1 and 2, a preferred embodiment of a compressor embodying the invention is indicated generally at 32. A generally cylindrical, closed end compressor housing 34 is closed by a front head 36 to create an enclosed volume. A main drive shaft 38 is rotatably supported in front head 36 and turns an eccentric pin 40 at a radial offset Ro relative to the main drive shaft axis A. A fixed scroll, indicated generally at 42, is interfitted with an orbital scroll 44. Fixed scroll 42 is secured immovably within housing 34, while orbital scroll 44 is rotatably supported on eccentric pin 40 by a conventional eccentric bushing and counterweight assembly 46, which allows pin 40 to drive orbital scroll 44 relative to fixed scroll 42 with the relative radial offset Ro. Supporting the thrust load as orbital scroll 44 is driven is a simple, flat thrust plate 48, captured between the back of orbital scroll 44 and front head 36. Behind fixed scroll 42 is a conventional high pressure chamber 50. Each scroll 42 and 44 is basically a conventionally generated involute spiral. Fixed scroll 42 has congruent inner and outer wraps 52 and 54, separated by a constant thickness t, and covering two turns, terminating radially at an outer edge or tail 56. An end plate 58, which forms one side of the pressure chamber 50, and an end edge 60, which carries a tip seal (not shown in FIG. 2), axially bound the wraps 52 and 54. Orbital scroll 44 has the same basic shape as fixed scroll 42, meaning it is congruent to and symmetrical thereto, apart from the location of the anti-rotation features described in detail below. Orbital scroll 44 has inner and outer wraps 62 and 64, separated by the same thickness t, and also covers two turns, ending at tail 66. An end plate 68 and end edge 70, which also carries a conventional tip seal, complete the orbital scroll 44. It should be noted that there would typically be some kind of anti-rotation mechanism in the location of the thin thrust plate 48, complete with all of the alignment pins and slots needed to fix it in the proper location. Here, the anti-rotation mechanism is replaced by features incorporated integrally into the scrolls 42 and 44 themselves, described in detail below.

Figure 3:
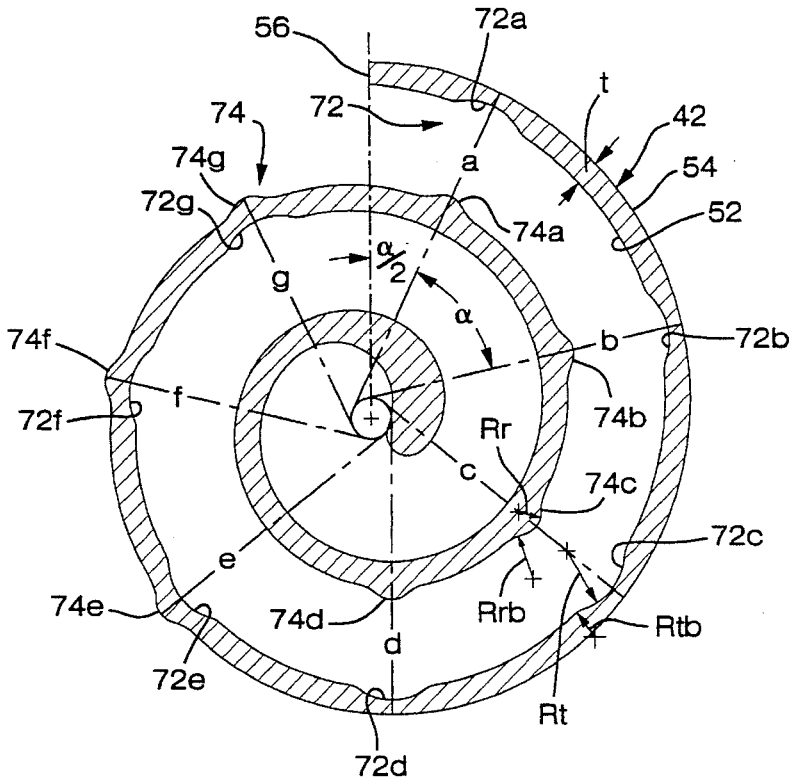
FIG. 3 is a cross section of the fixed scroll wraps, taken perpendicular to the scroll axis, and showing the relative location of the troughs and ridges relative to equally angularly spaced swing radius lines.

Referring next to FIG. 3, the fixed scroll 42 is shown in cross section, as well as its generating circle and seven equally angularly spaced swing radii, denoted at a–g. The inner wrap 52 and outer wrap 54 are respectively machined with seven integral, semi cylindrical troughs 72, sub designated at **72*a* through 72*g*, and equal number of similar, though smaller radius ridges 74, sub designated at 74*a* through 74*g* respectively. Some troughs 72 and ridges 74 are in opposed pairs across the wraps 52 and 54, and others are alone, as is described in more detail below. The increment of angular spacing alpha is approximately 51 degrees. The troughs 72 and ridges 74 are sub designated to correspond to the seven equally spaced swing radius lines a–g on which their centers lie. The radius of each trough 72, indicated at Rt, is sufficiently larger than the corresponding radius of each ridge 74, indicated at Rr, that the difference between them, (Rt–Rr), is equal to the orbit radius Ro. And, again, the orbit radius Ro is equal to (P/2)–t, where P is the scroll spiral's pitch (that is, the circumference of the generating circle) and t is the scroll thickness. The location of the first trough 72*a* on the fixed scroll inner wrap 52 is somewhat arbitrary, though it should be relatively near, but not right at, the tail edge 56, so as to not weaken it. Here, the location of first trough 72*a* is chosen, in angular terms, to be one half of alpha, as measured counterclockwise from a vertical plane (represented by the dotted in FIG. 3) that runs through the tail 56 and through the center of the generating circle. That initial location could be closer to or farther from tail 56, as noted, but wherever it is, the location of the next six successive troughs 72*b*–72*g* will each lie on a swing radius line spaced apart by one whole angular increment alpha. As many troughs 72 are machined into inner wrap 52 alone, that is, without opposed ridges 74 on the outer wrap 54, as will fit on the first 180 degrees. Here, with alpha equal to about 51 degrees, and with the first trough 72*a* located where it is, that means that the first four troughs, 72*a* through 72*d*, are alone. Thereafter, each remaining trough 72***e* through 72*g* is backed by a corresponding ridge 74*e* through 74*g*, machined onto the outer wrap 54, with their centers lying on the same swing radius lines as the troughs 72*a–d*. The three remaining ridges 74*a* through 74*d* are alone on the outer wrap 54, with no corresponding troughs 72. A further detail of the shape of the troughs 74 and ridges 72 is their transition into their respective inner wraps 52 and outer wraps 54. That transition is not a sharp corner but, instead, a radiused corner. The larger radius comprising the corner transition between each ridge 74 and the outer wrap 54 is indicated at Rrb, and the corresponding smaller transition radius between each trough 72 and the inner wrap 52 is indicated at Rtb. The difference between the two, (Rrb–Rtb) must be less than or equal to the orbit radius Ro, for reasons discussed below. In theory, the absolute values for Rtb and Rrb could be any amount, (although, obviously, smaller than the radii of the respective troughs 72 and ridges 74) so long as their subtracted difference met the condition prescribed. As a practical matter, however, the method by which the wraps 52, 54 and the integral troughs 72 and ridges 74 are machined has to be kept in mind. A milling tool of a fixed radius is used to machine the surfaces, and it cannot machine an arc smaller than its own radius, though it can machine a larger arc. Therefore, the smaller of the blend radii, Rtb, should not be smaller than the tool radius, for efficient machining.

Figure 4:
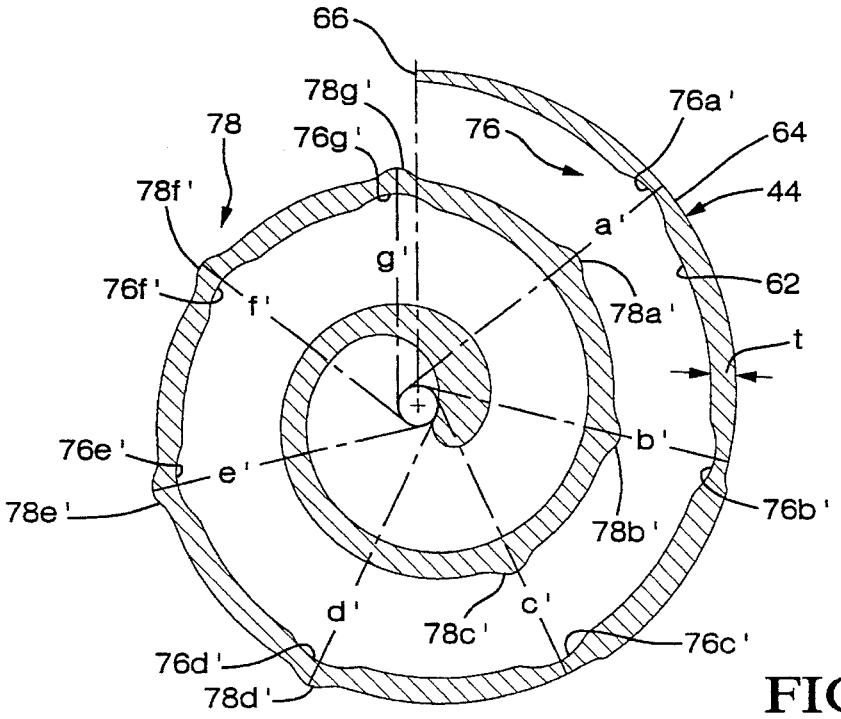
FIG. 4 is a cross section of the orbital scroll wraps, taken perpendicular to the scroll axis, and also showing the relative location of the troughs and ridges relative to equally angularly spaced swing radius lines.

Referring next to FIG. 4, the details of the orbiting scroll 44 may be much more briefly explained, because of its similarity to fixed scroll 42. The inner and outer scroll wraps 62 and 64 have the same generating circle, which is illustrated along with seven equally spaced swing radius lines a'–g'. The first swing radius line a' is located a full angular increment alpha counterclockwise from the dotted vertical line that rims though the tail 66 and the origin of the generating circle, rather than one half alpha. Seven semi cylindrical troughs 76, sub designated at 76*a'* through 76*g'*, are machined into inner wrap 62, with the same size and shape as the fixed scroll troughs 72, and with their centers lying on the seven swing radius lines a'–g'. Seven semi cylindrical ridges 78, sub designated at 78*a'* through 78*g'*, are machined into outer wrap 64, with the same size and shape as the fixed scroll ridges 74. Here, because the first trough 76*a'* is farther from the tail 66, only the first three, 76*a'–c'* are machined into the first 180 degrees of inner wrap 62 alone, without a corresponding ridge 78. Then, the final four troughs 76*d'* through 76*g'* are backed by corresponding ridges 78*d'* through 78*g'*. The final three ridges, 78*a'* through 78*c'*, reside on the outer wrap 64 alone, without corresponding troughs 76. Thus, only the fact that the orbital scroll's array of troughs 76 and ridges 78 is offset by one half of the angular increment alpha relative to the fixed scroll's troughs 72 and ridges 76 distinguishes the fixed scrolls wraps 52 and 54 from the orbiting scroll wraps 62 and 64. This relative angular difference or shift between the two sets of troughs and ridges allows the scrolls 42 and 44 to interfit and operate as described below.

Figure 5:
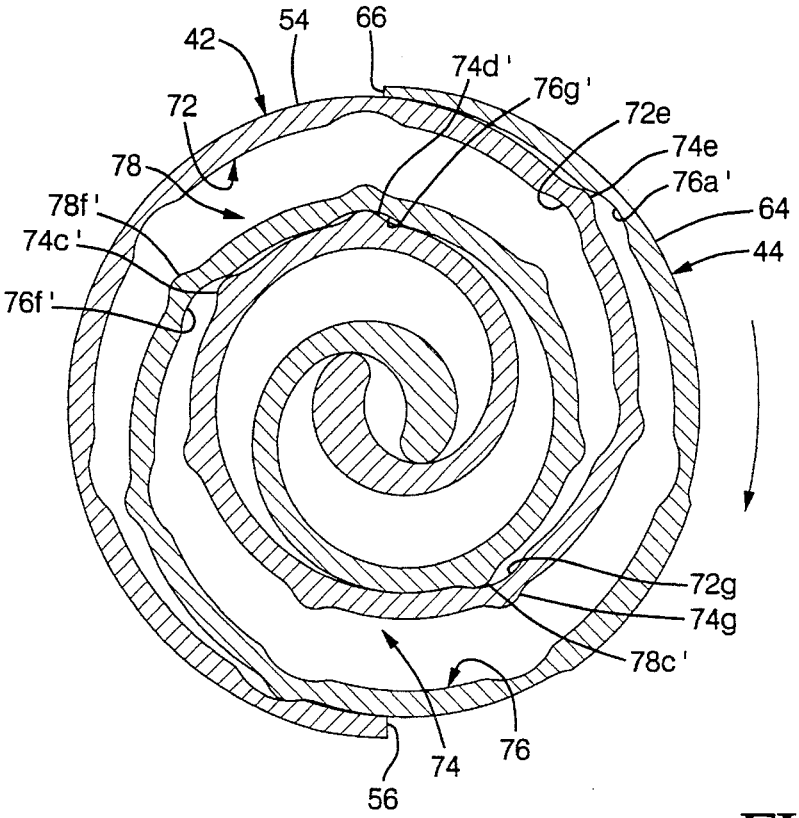
FIG. 5 is a cross section of the scrolls interfitted as they would be after installation and at the beginning of operation.
Figure 15:
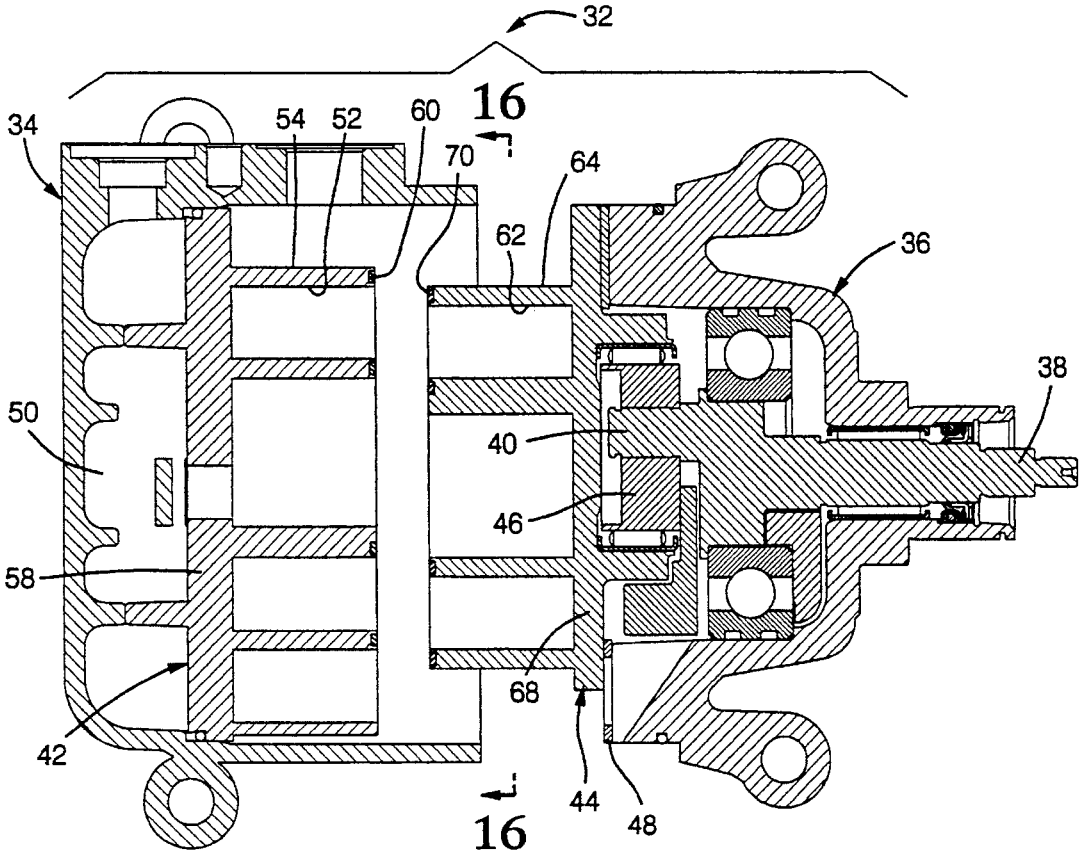
FIG. 15 is a view showing the coaxial compressor front head and housing before being secured together, with the orbital scroll and fixed scrolls installed therein but not yet interfitted.
Figure 16:
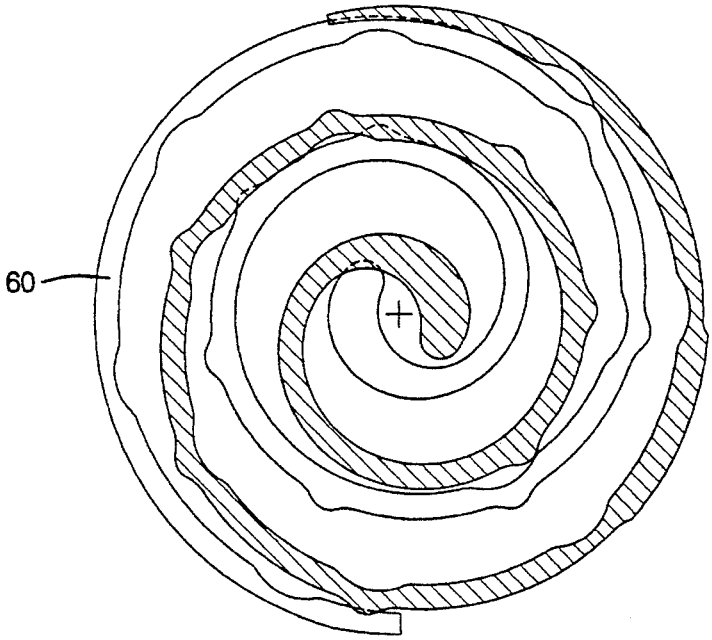
FIG. 16 is a cross sectional view along the line 16—16 of FIG. 15 of the two scrolls as they would interfere if an attempt to interfit the scrolls when they were not aligned.
Figure 17:
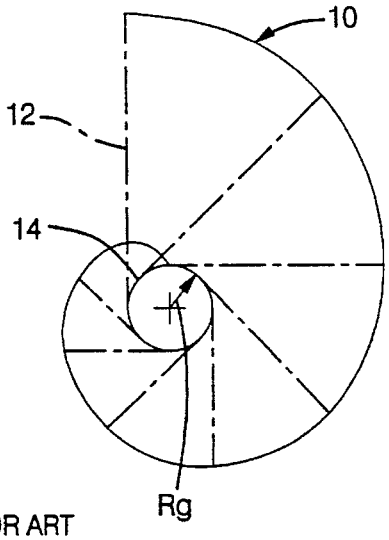
PRIOR ART FIG. 17
FIG. 17 is the general diagram of a theoretical scroll involute referred to above.
Figure 18:
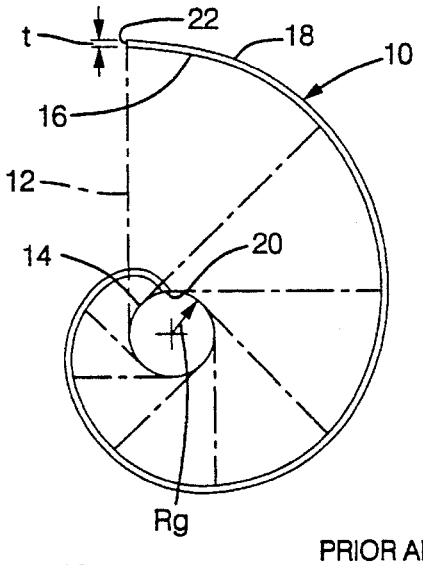
PRIOR ART FIG. 18
FIG. 18 is the general diagram of an actual scroll cross section referred to above.
Figure 19:
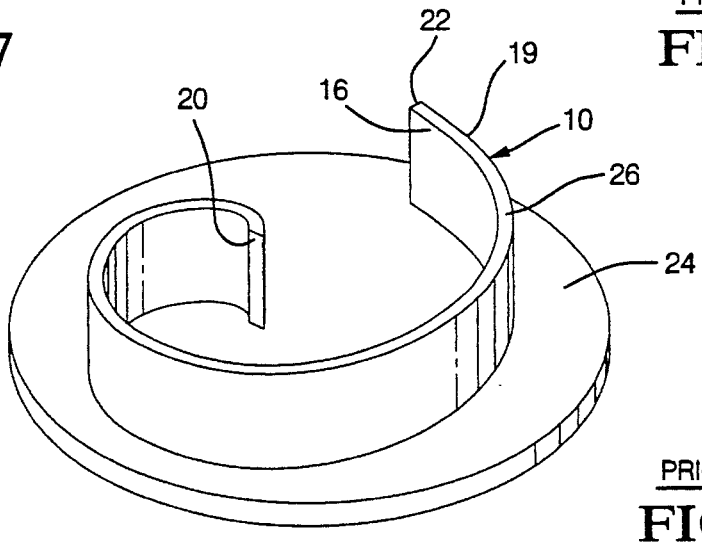
PRIOR ART FIG. 19
FIG. 19 is the perspective view of a scroll referred to above.
Figure 20:
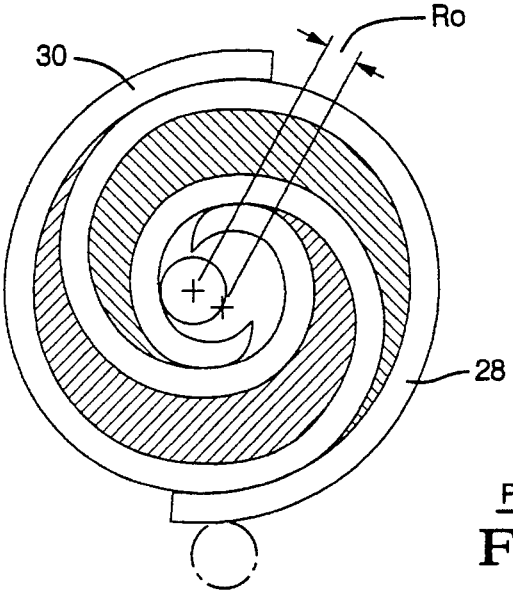
PRIOR ART FIG. 20
FIG. 20 is the cross sectional view of two interfitted scrolls referred to above.

Referring next to FIGS. 15, 16 and 5, compressor 32 is assembled by first securing fixed scroll 42 into housing 34 and installing shaft 38, bushing assembly 46 and orbital scroll 44 into front head 36, giving the two subassemblies shown in FIG. 15. Fixed scroll 42 is secured immovably within housing 34, by screws or the like, but has no preferred angular orientation within housing 34 as such. Orbital scroll 44 can freely rotate within front head 36, on busing assembly 46, since there is only the plate 48 separating them. Then, the front head 36 is moved axially toward the housing 34 while maintaining the two coaxial, and the scrolls 42 and 44 are turned relative to one another (by turning the housing 34, head 36, or both) until the scrolls 42 and 44 are capable of moving past one another without hitting each other. This will be possible only when the two scrolls 42 and 44 are sufficiently angularly aligned, and if they are not, then there will be interference and overlap at several locations, as shown in FIG. 16, that will prevent their axial interfit. For example, as shown in FIG. 16, ridge 78*d'* hits end edge 60, ridge 74*c* hits end edge 70, and ridge 74*d* hits end edge 70. When the orbital scroll 44 has been tamed enough from the FIG. 15 position, then the ridges just noted can miss, some of which move into specific troughs, as noted in more detail below, and the scrolls 42 and 44 will be aligned. In effect, they self align. The scrolls 42 and 44 then can be pushed axially past one another to allow the housing 34 and front head 36 to seat against each other and be bolted together to complete compressor 32. This self aligning assembly feature is a great advantage compared to methods of alignment necessary to install conventional compressors with conventional, separate anti rotation mechanisms. However, it is almost a by product, although a very useful by product, of the basic function of the various troughs 72, 76 and ridges 74, 78. That basic function is to provide anti-rotation of the orbital scroll 44 relative to the fixed scroll 42 in operation, as is described next.

Referring next to FIG. 5, the beginning of a cycle of orbiting scroll 44 relative to fixed scroll 42 is illustrated. It and the Figures that follow are snap shots at best, and inherently somewhat limited in their ability to convey the true dynamics of the situation. Nevertheless, a careful comparison of the Figures that follow FIG. 5 in order will illustrate the anti-rotation features at work. In general, when the scrolls 42 and 44 are operating, orbital scroll 44 orbits counterclockwise relative to (but does not rotate relative to) fixed scroll 42, as shown by the arrow, and various pairs of ridges and troughs make contact. Those ridges in contact slide along and through the troughs, matching and corresponding to the relative orbital motion induced by the drive mechanism between the scrolls. The orbital motion is matched because of the fact that the trough-ridge pairs lie centered on the same swing radius lines, and because the difference between the radii of the troughs and ridges is made equal to Ro. The ridge-trough pairs in contact change throughout the cycle, with some always engaging and some disengaging at any point in time, but there are generally three pairs in contact at any time. These include two adjacent ridges that are in contact with opposite sides adjacent troughs, which prevents relative scroll rotation in each direction. "Adjacent" is taken to mean lying on adjacent swing radius lines, even if not on the same turn of the wrap. At the same time, a third trough-ridge pair at a substantially diametrically opposed point to the two adjacent pairs that are in contact, and in which the ridge is in a "neutral" position, with the ridge at the center of the trough but in the process of switching over to the other side of the trough, so as to prevent relative rotation in a new direction, and thereby take over for an adjacent trough-ridge pair that is just breaking contact. The same through-ridge pairs repeatedly make and break contact throughout the cycle, since there is no relative scroll rotation. Stated conversely, there is no relative scroll rotation because of the way in which those same trough-ridge pairs continually make and break contact, as will be explained below. In addition, the opposed, line contacting inner and outer wrap pairs, 52 against 64 and 54 against 62, form the basic gas pockets described above, and those lines of contact will move into and through the contacting ridge-trough pairs.

Still referring to FIG. 5, orbital scroll ridge 78*d'* is in contact with the outer half of fixed scroll trough 72*a*, and the adjacent ridge orbital scroll ridge 78*c'* is in contact with the inner half of the adjacent fixed scroll trough 72*g*. "Outer half" of a trough is used to mean the quarter circle portion thereof encountered while moving radially outwardly along a wrap, and "inner half" the other quarter circle. Thus, orbital scroll 44 is thus prevented from rotating relative to fixed scroll 42 in both the counterclockwise and clockwise directions, at any point in the cycle, because, in attempting to rotate, two of the orbital scroll ridges 78' will "catch" on opposed halves of two of the fixed scroll troughs 72, and is effectively trapped and confined. At a point approximately diametrically opposed to the two orbital scroll ridges 78*c'* and 78*d'* that are in contact, fixed scroll ridge 74*d* is in contact with the approximate center of orbital scroll trough 76*g'*, a neutral position, but ridge 74*d* is in fact moving toward contact with the inner half of orbital scroll trough 76*g'*, where it will prevent orbital scroll 44 from rotating counterclockwise, thereby taking over for ridge 78*c'* and trough 72*g*, which are about to break contact. In addition, though not obvious from the static drawing, ridge 74*e* is beginning to move into contact with the outer half of trough 76*a'*. This basic pattern of contact is maintained throughout the cycle, but with different ridge-trough pairs in contact at any point in time.

Figure 6:
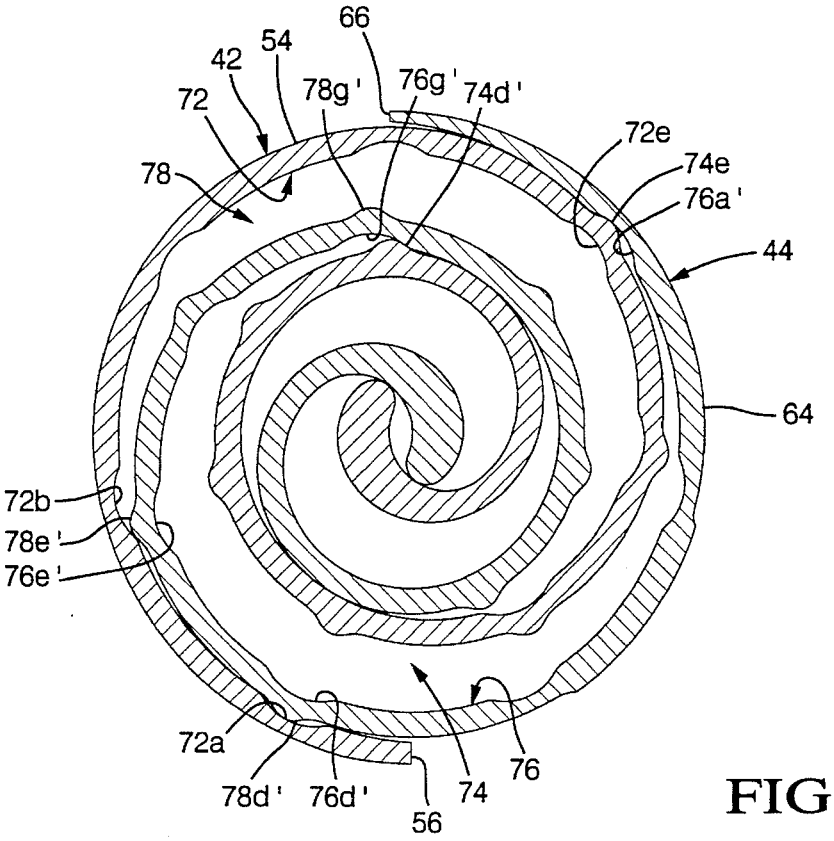
FIGS. 6 through 14 are views like FIG. 5, but showing progressive points in one orbiting cycle of the scrolls, and indicating the successive engagement and disengagement of trough and ridge pairs throughout an orbiting cycles.

Referring next to FIG. 6, a static point further along in the cycle is illustrated. Now, ridge 74*d* has moved past the neutral point and into contact with the inner half of trough 76*g'*, preventing counterclockwise rotation, and the adjacent ridge 74*e* has moved into contact with the outer half of adjacent trough 76*a'*, preventing clockwise rotation. Ridge 78*d'* has moved to a near neutral position within trough 72*a*, but is moving toward the inner half of trough 72*a*, where it can prevent clockwise relative rotation, thus taking over for the previous contact between ridge 78*c'* and the inner half of trough 72*g*, which has just broken, and which was preventing clockwise rotation at the point in the cycle shown in FIG. 5.

Figure 7:
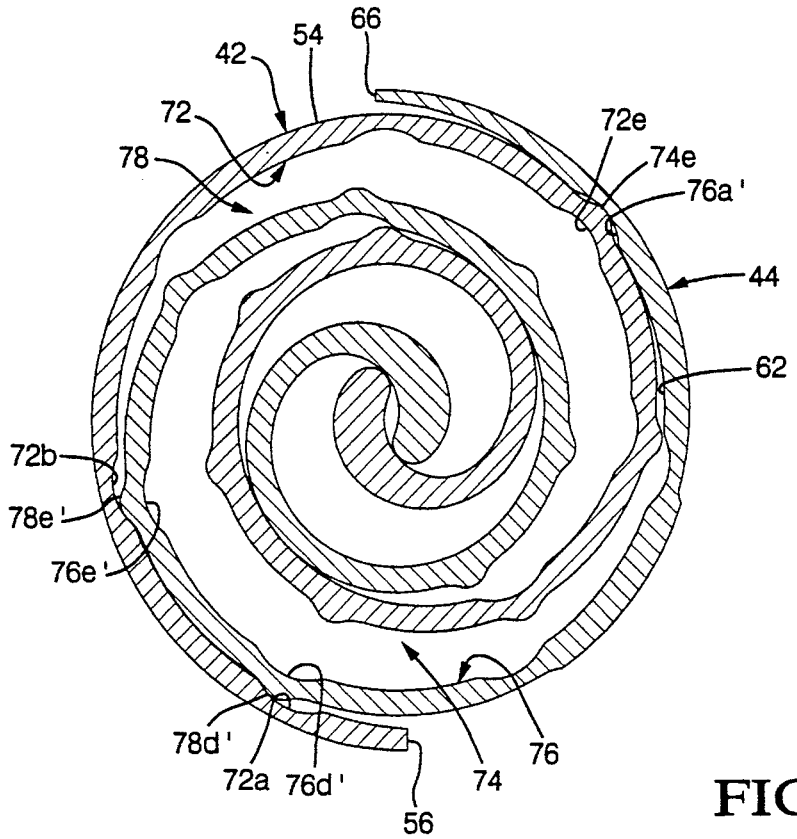

Referring next to FIG. 7, ridge 78*e'* has moved into contact with the outer half of trough 72*b*, preventing counterclockwise rotation, and the adjacent ridge 78*d'* has now moved past the neutral point and into contact with the inner half of adjacent trough 72*a*, preventing clockwise rotation, as it was near to doing in FIG. 6. At a point diametrically opposed to the ridges in contact, ridge 74*e* is near the neutral center of trough 76*a'*, but is moving toward the inner half of trough 76*a'*, where it will prevent counterclockwise relative rotation. The adjacent ridge-trough pair 74*d*–76*g'*, which was still in contact in FIG. 6, has just broken contact Referring next to FIG. 8, ridge 74*e* has moved past the neutral point and into contact with the inner half of trough 76*a'*, preventing counterclockwise relative rotation, as it was near to doing in FIG. 7. Adjacent ridge 74*f* has moved into contact with the outer half of trough 76*b'*, preventing clockwise rotation. At a point diametrically opposed to the ridges in contact, ridge 78*e'* is near a neutral position within trough 72*a*, but is beginning to move to its inner half, so as to provide clockwise rotation prevention.

Figure 9:
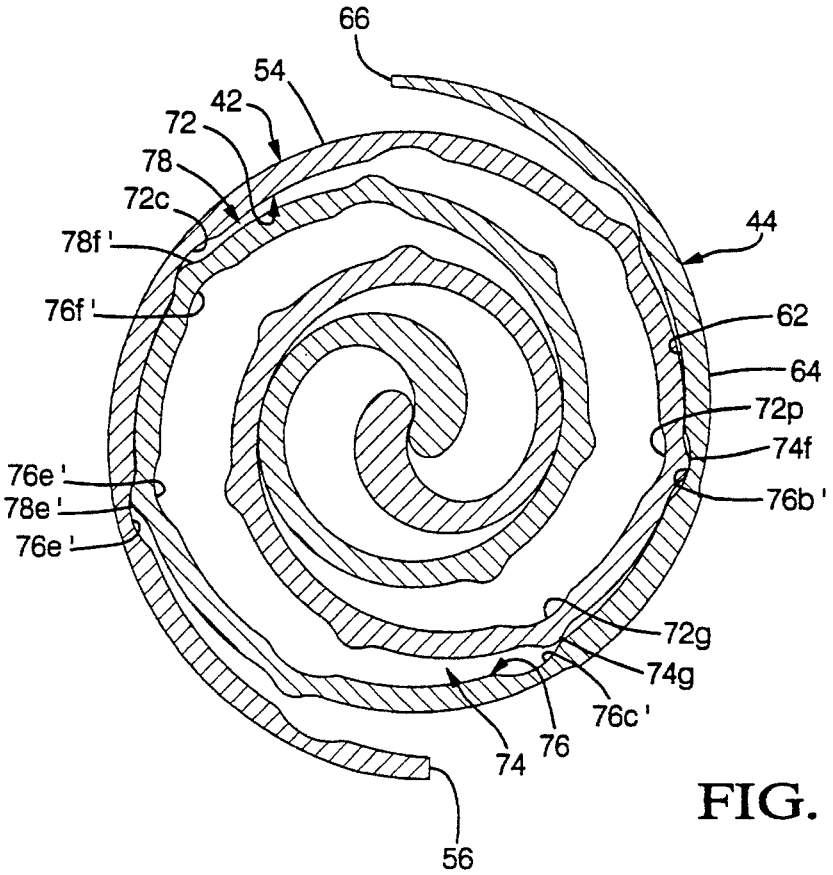

Referring next to FIG. 9, ridge 78*e'* has moved into contact with the inner half of trough 72*b*, preventing clockwise rotation, while the adjacent ridge 78*f'* has moved into contact with the outer half of the adjacent trough 72*c*, preventing counterclockwise rotation. At a point diametrically opposed to the two ridges in contact, ridge 74*f* is near a neutral position, but is beginning to move toward contact with the inner half of trough 76*b'*, where it will prevent counterclockwise rotation.

Figure 8:
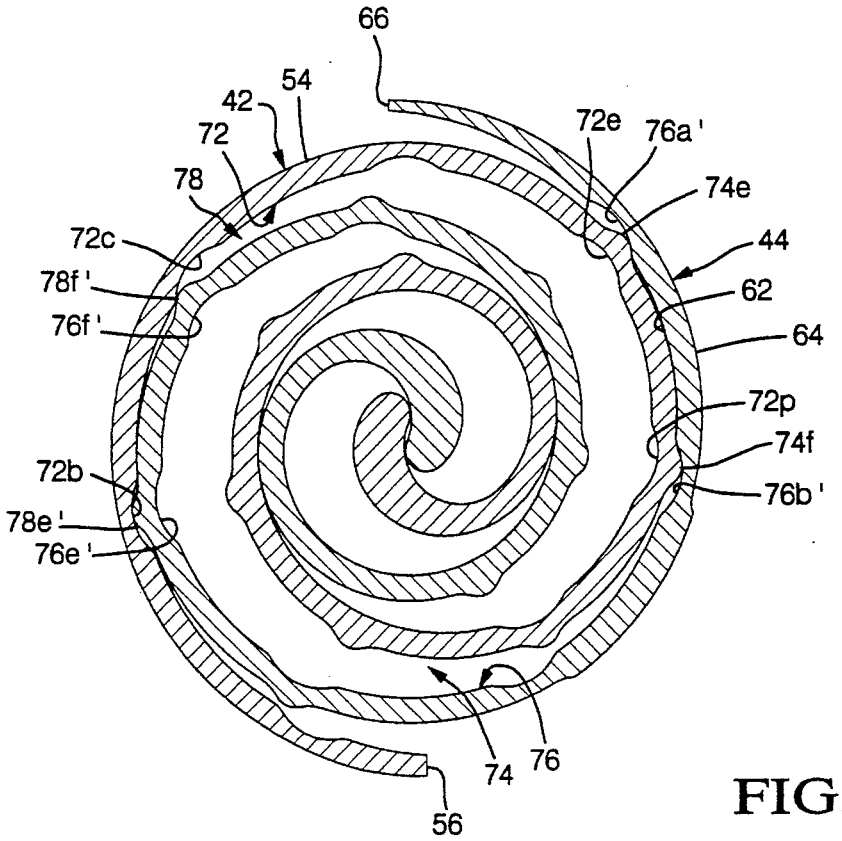
Figure 10:
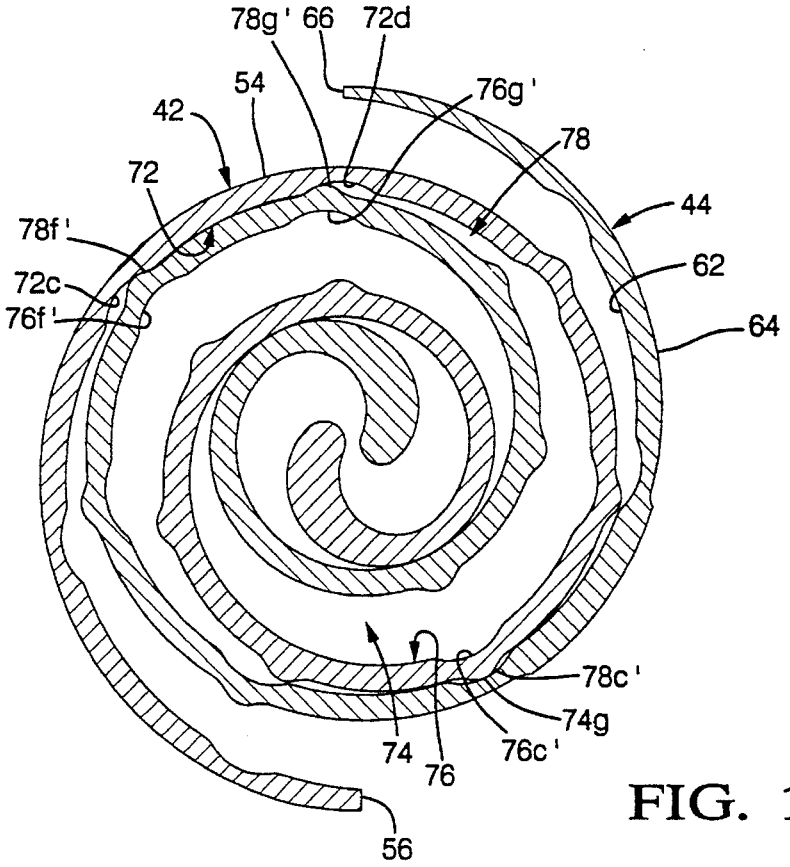

Referring next to FIG. 10, the orbital scroll 44 has moved over a greater angle relative to its FIG. 9 position, as compared to the angular change between FIGS. 8 and 9, so ridge 74*f* has moved completely out of contact with trough 76*b'*. But, the general pattern remains the same. Ridge 78*f'* is in contact with the inner half of trough 72*c*, preventing clockwise relative rotation, and adjacent ridge 78*g'* is in contact with the outer half of adjacent trough 72*d*, preventing counterclockwise rotation. Again, at a point substantially diametrically opposed to the two ridges in contact, ridge 74*g* is in a neutral position near the center of trough 76*c'*, but is beginning to move toward the inner half of trough 76*c'*, where it will prevent counterclockwise rotation.

Figure 11:
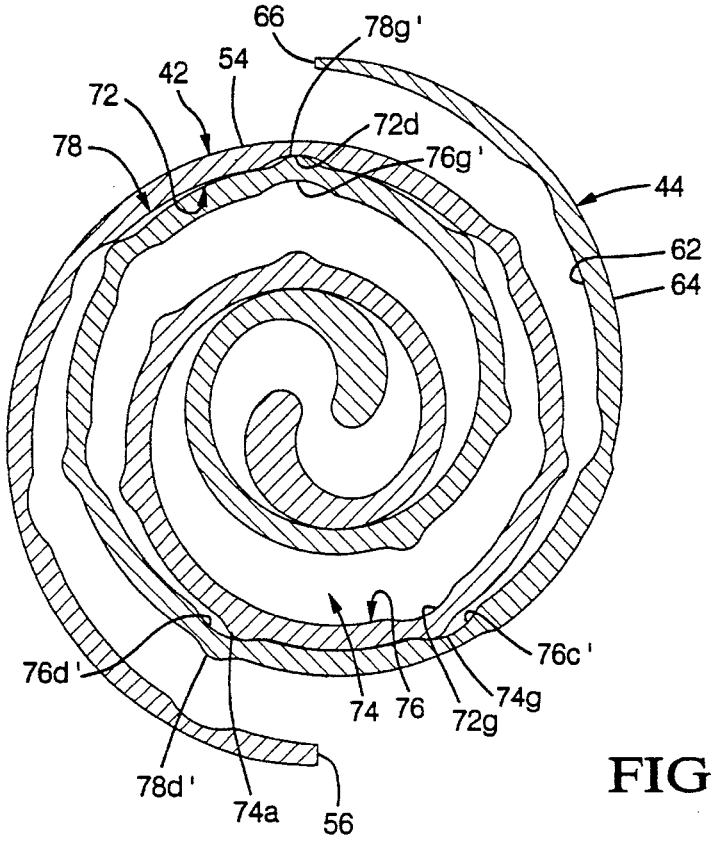

Referring next to FIG. 11, ridge 74*g* has moved into contact with the inner half of trough 76*c'*, preventing counterclockwise relative rotation, and adjacent ridge 74*a* has moved into contact with the outer half of adjacent trough 76*d'*, preventing clockwise rotation. At a point substantially diametrically opposed to the ridges in contact, ridge 78*g'* is in a neutral position near the center of trough 72*d*, but is beginning to move toward the inner half of trough 72*d*, where it will prevent clockwise rotation.

Figure 12:
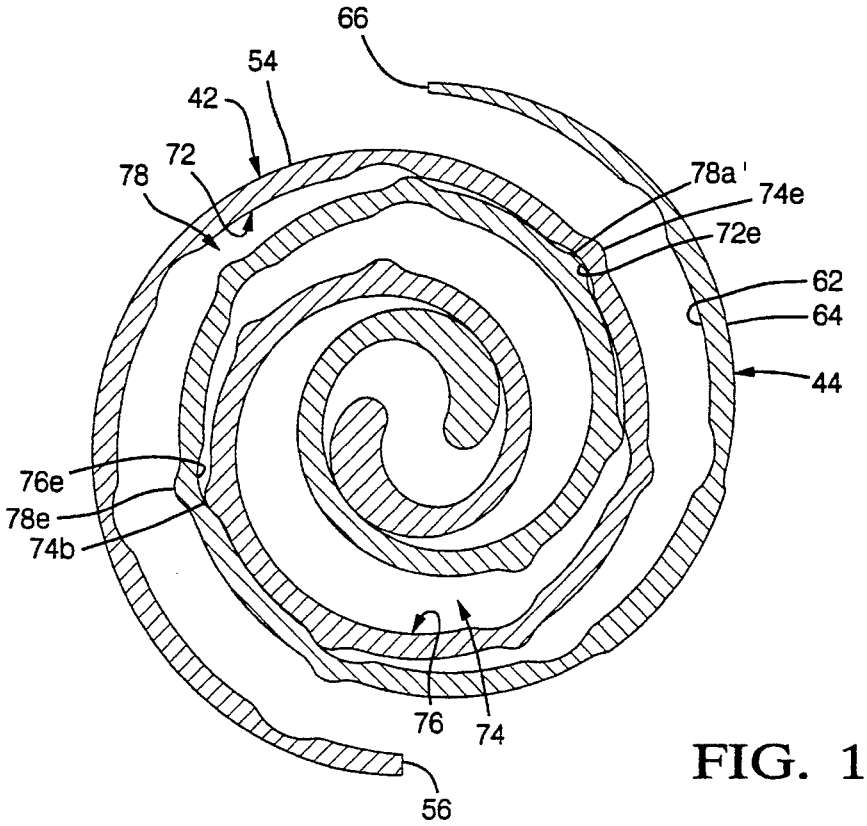

Referring next to FIG. 12, orbital scroll is shown again having moved over a greater angle, as it was shown in FIG. 10. So, ridge 78*g'* has moved completely out of contact with trough 72*d*. But, again, the general pattern noted is the same. Ridge 74*b* is in contact with the outer half of trough 76*e'*, preventing clockwise rotation, while adjacent ridge 74*a* is in contact with the inner half of adjacent trough 76*d'*, preventing counterclockwise rotation. At a point substantially diametrically opposed to the ridges in contact, ridge 78*a'* is in a neutral position near the center of trough 72*e*, but is beginning to move toward the inner half of trough 72*e*, where it will prevent clockwise rotation.

Figure 13:
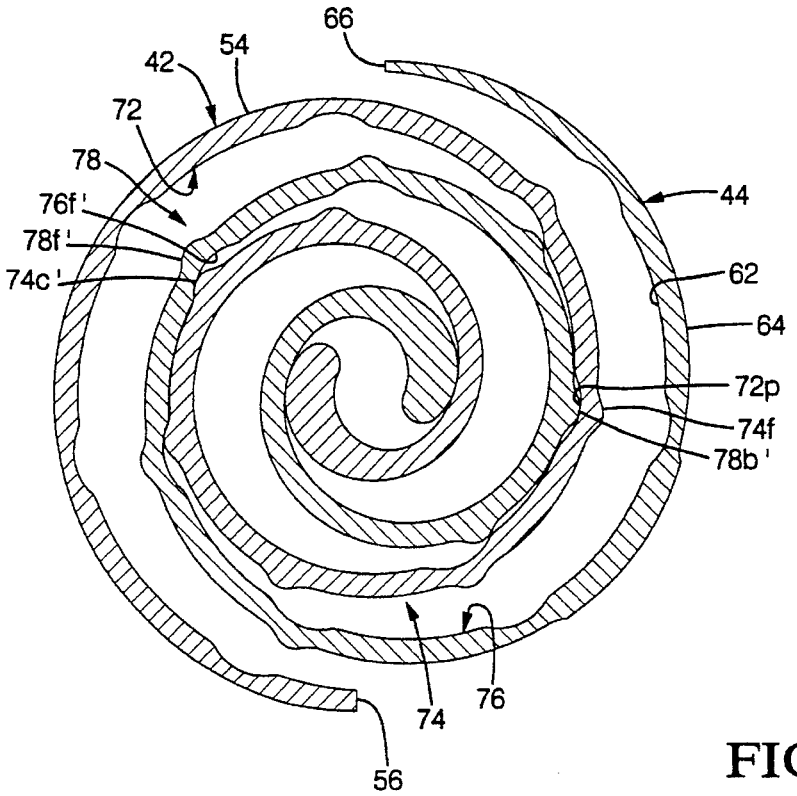

Referring next to FIG. 13, orbital scroll 44 is again shown as having moved over the greater angle, from the FIG. 12 position. so that ridge 78*a'* is out of contact with trough 72*e*. Now, ridge 74*c* is in contact with the outer half of trough 76*f'*, preventing clockwise relative rotation, while adjacent ridge 74*b* is in contact with the inner half of adjacent trough 76*e'*, preventing counterclockwise rotation. At a point substantially diametrically opposed to the ridges in contact, ridge 78*b'* is in a neutral position near the center of trough 72*f*, but is beginning to move toward the inner half of trough 72*f*, where it will prevent clockwise rotation.

Figure 14:
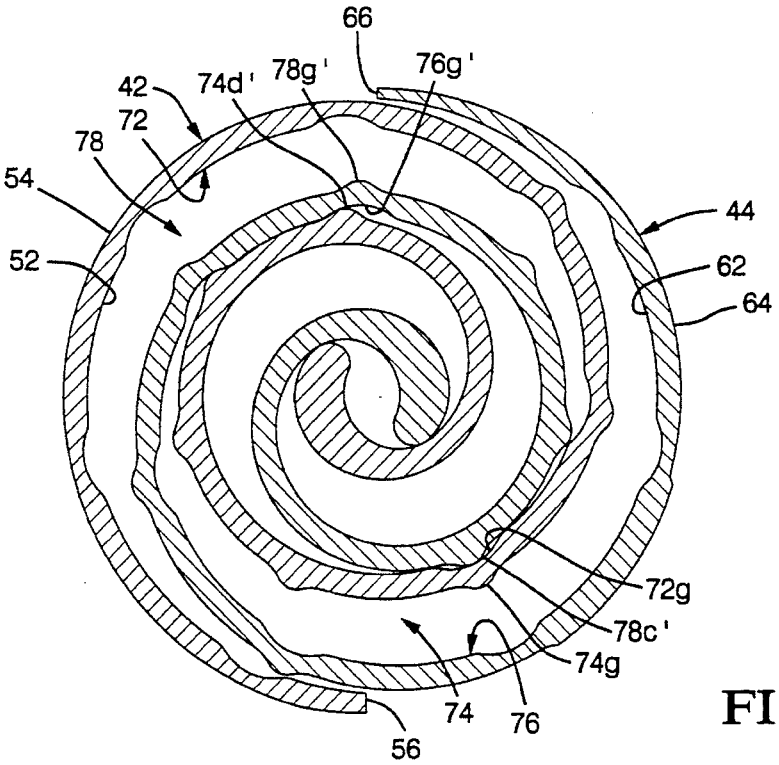

Referring finally to FIG. 14, the scrolls have moved back to a position near the starting point of FIG. 5, and ridge 74*c* is in contact with the inner half of trough 76*f'*, preventing counterclockwise relative rotation, while adjacent ridge 74*d* is in contact with the outer half of adjacent trough 76*g'*, preventing clockwise rotation. At a point substantially diametrically opposed to the ridges in contact, ridge 78*c'* is in a neutral position near the center of trough 72*g*, but is beginning to move toward the inner half of trough 72*g*, (as it is shown in FIG. 5) where it will prevent counterclockwise rotation. Thus, a general and consistent pattern is apparent in which, at any point in the cycle, adjacent ridges on one scroll contact opposed halves of troughs on the other scroll, preventing relative scroll rotation in both directions, while, at the same time, at a point almost diametrically opposed to the two ridges in operative contact, a ridge on the other scroll is moving through a neutral position in a trough on the one scroll, ready to change the direction of relative rotation that it provides, and thereby take over for an adjacent ridge pair that has just broken contact. Throughout this continual and repetitive making and breaking of ridge-trough contact pairs, the relationship between the blend or transition radii noted above assure that there is no interference between the "corners" of the ridges and troughs.

Variations in the embodiment disclosed could be made. The ridges could be formed on the inner wraps, rather than the outer, and vice versa for the troughs, and the pairs of troughs and ridges would still contact in the same fashion. However, it should be easier to machine the convex ridges on the convex outer wraps and the concave troughs on the concave inner wraps. More or fewer pairs of troughs and ridges could be provided, but, as a practical matter, they should not be many fewer, or many more, than the seven shown, unless the scroll wraps covered more turns. There should be sufficient pairs of troughs and ridges to always assure two pairs in contact, as illustrated. Too many would present extra machining and potentially weaken the scrolls. As noted, the beginning point for the first trough, relative to the tail of the scroll, is somewhat arbitrary, so long as the troughs and ridges on each scroll are equal in number, equally spaced, and shifted relative to one another by one half the increment of spacing between them. The troughs and ridges shown run the entire axial length of the scroll wraps, though they could be shorter, so long as they had sufficient surface area in contact to assure relative rotation prevention. Therefore, it will be understood that it is not intended to limit the invention to just the embodiment disclosed.

I claim:

1. In a scroll compressor of the type having a fixed spiral involute scroll having inner and outer wraps defined by a swing radius traveling about the axis of a generating circle and a similarly defined, congruent and symmetrical orbital scroll with inner and outer wraps and in which said scrolls are interfitted with their axes parallel and with a predetermined angular offset and a predetermined radial offset between said axes, and said orbital scroll is orbited relative to said fixed scroll while maintaining said radial offset and angular offset, an improved mechanism to prevent said orbital scroll from rotating relative to said fixed scroll and thereby maintain said angular offset, comprising, a plurality of pairs of semi cylindrical, interfitting pairs of larger radius troughs and smaller radius, semi cylindrical ridges formed integrally on the contacting wraps of said scrolls at substantially equally angularly spaced locations along said wraps, said troughs and ridges having central axes that lie on a swing radius line at each equally spaced location and extending parallel to said scroll axes, said interfitting pairs of troughs and ridges being sufficient in number that at least two pairs of troughs and ridges are interengaged at all times as said scrolls orbit relative to one another, with the radius of said troughs being sufficiently larger than the radius of said ridges that the difference therebetween is equal to said predetermined radial offset, whereby, when said fixed scroll and orbital scroll are moved axially together so as to interfit with said radial offset, said ridges of one scroll are able to move axially into the troughs the other scroll, and vice versa, only when said angular offset has been substantially achieved, and when said orbital scroll is orbitally driven relative to said fixed scroll while maintaining said radial offset between the two scrolls, successive ridges simultaneously move through and along respective troughs and prevent said scrolls form rotating relative to one another, thereby maintaining said predetermined angular offset during compressor operation.

2. In a scroll compressor of the type having a fixed spiral involute scroll having inner and outer wraps defined by a swing radius traveling about the axis of a generating circle and a similarly defined, congruent and symmetrical orbital scroll with inner and outer wraps and in which said scrolls are interfitted with their axes parallel and with a predetermined angular offset and a predetermined radial offset between said axes, and said orbital scroll is orbited relative to said fixed scroll while maintaining said radial offset and angular offset, an improved mechanism to prevent said orbital scroll from rotating relative to said fixed scroll and thereby maintain said angular offset, comprising, a plurality of semi cylindrical troughs formed integrally on one wrap of one scroll, parallel to its axis, spaced apart by a substantially equal angular increment and lying on swing radius lines at said angular increments, with the first of said troughs being angularly spaced by said increment inboard of a plane that is formed through said one scroll's axis and its outer edge, each trough having a predetermined trough radius, said one scroll also having an equal plurality of equally angularly spaced semi cylindrical ridges formed integrally on the other wrap, also parallel to its axis and lying on the same swing radius lines, said ridges starting inboard of the first half mm of said one scroll wrap, each ridge having a ridge radius sufficiently smaller than said trough radius such that the difference between said trough radius and said ridge radius equals said predetermined radial offset, and, a plurality of same size semi cylindrical troughs formed integrally on the same wrap of the other scroll, parallel to its axis, spaced apart by a substantially equal angular increments and lying on swing radius lines at said angular increments, but with the first of said troughs being angular spaced said one half of said increment of a plane that is formed through said other scroll's axis and its outer edge, said other scroll also having an equal plurality of same size semi cylindrical ridges formed integrally on its other wrap, also parallel to its axis, and also starting inboard of the first half turn of said other scroll wrap, whereby, when said fixed scroll and orbital scroll are moved axially together so as to interfit with said radial offset, said ridges of one scroll are able to move axially into the troughs the other scroll, and vice versa, only when said angular offset has been substantially achieved, and when said orbital scroll is orbitally driven relative to said fixed scroll while maintaining said radial offset between the two scrolls, successive ridges simultaneously move through and along respective troughs and prevent said scrolls form rotating relative to one another, thereby maintaining said predetermined angular offset during compressor operation.

* * * * *